US009134683B2

(12) United States Patent
Jang et al.

(10) Patent No.: US 9,134,683 B2
(45) Date of Patent: Sep. 15, 2015

(54) IMAGE FORMING APPARATUS HAVING A CLEANING UNIT TO CLEAN AN OPTICAL SENSOR UNIT

(71) Applicant: SAMSUNG Electronics Co., Ltd., Suwon-si, Gyeonggi-do (KR)

(72) Inventors: Jeong Hun Jang, Suweon-si (KR); Dong Hun Han, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 13/869,058

(22) Filed: Apr. 24, 2013

(65) Prior Publication Data

US 2013/0287427 A1 Oct. 31, 2013

(30) Foreign Application Priority Data

Apr. 25, 2012 (KR) ..... 10-2012-0043206

(51) Int. Cl.
*G03G 15/00* (2006.01)
*G03G 21/00* (2006.01)

(52) U.S. Cl.
CPC ..... *G03G 21/00* (2013.01); *G03G 15/5058* (2013.01)

(58) Field of Classification Search
CPC ..... G03G 15/221; G03G 15/75; G03G 15/04; G03G 15/0841; G03G 15/101; G03G 15/09; G03G 15/201
USPC ..... 399/4, 26, 32, 55, 106, 245, 268, 337
See application file for complete search history.

(56) References Cited

U.S. PATENT DOCUMENTS

| | | | | |
|---|---|---|---|---|
| 6,069,641 | A * | 5/2000 | Matsuno et al. | 347/115 |
| 2006/0029408 | A1* | 2/2006 | Suzuki et al. | 399/49 |
| 2007/0258072 | A1* | 11/2007 | Nagasaka et al. | 355/53 |
| 2009/0232562 | A1* | 9/2009 | Hazeyama | 399/266 |
| 2013/0033715 | A1* | 2/2013 | Takasaki et al. | 358/1.12 |

* cited by examiner

*Primary Examiner* — Walter L Lindsay Jr
*Assistant Examiner* — Roy Y. Yi
(74) *Attorney, Agent, or Firm* — Staas & Halsey LLP

(57) ABSTRACT

An image forming apparatus includes a photosensitive unit to form an visible image, a printing medium storage unit to store a printing medium, a pickup device to pick up the printing medium from the printing medium storage unit, a developing unit to develop the electrostatic latent image of the photosensitive unit into a visual image, an optical sensor to inspect the visual image, and a cleaning unit to clean a light window arranged at the optical sensor according to a control of the pickup device.

20 Claims, 5 Drawing Sheets

IMAGE FORMING APPARATUS HAVING A CLEANING UNIT TO CLEAN AN OPTICAL SENSOR UNIT

CROSS-REFERENCE TO RELATED APPLICATIONS

This application claims priority under 35 U.S.C. §119 from Korean Patent Application No. 2012-0043206, filed on Apr. 25, 2012 in the Korean Intellectual Property Office, the disclosure of which is incorporated herein by reference in its entirety.

BACKGROUND OF THE INVENTION

1. Field of the Invention

Embodiments of the present general inventive concept relate to an image forming apparatus including an optical sensor unit to inspect a visual image.

2. Description of the Related Art

An image forming apparatus forms an image on a printing medium according to an input signal. Examples of such an image forming apparatus include a printer, a copier, a facsimile machine, and a complex machine having functions of the above-mentioned appliances.

An electrophotographic image forming apparatus, which is a kind of image forming apparatus, includes a photosensitive body, an optical scanning unit, and a developing unit. The optical scanning unit scans light to the photosensitive body, which is charged with predetermined potential, to form an electrostatic latent image on the surface of the photosensitive body, and the developing device supplies a developing agent to the photosensitive body, on which the electrostatic latent image is formed, to form a visible image.

Toner used in the image forming apparatus generally has four colors, i.e., yellow (Y), magenta (M), cyan (C), and black (K), and four developing units are needed to fuse the toners of four colors on an electrostatic latent image.

In addition, such an image forming apparatus may include an optical sensor unit to inspect a developed visual image and a cleaning unit to clean toner accumulated on a light window of the optical sensor unit.

SUMMARY OF THE INVENTION

The present general inventive concept provides an image forming apparatus including an optical sensor unit to inspect a developed visual image and a cleaning unit to clean the optical sensor unit.

Additional features and utilities of the present general inventive concept will be set forth in part in the description which follows and, in part, will be obvious from the description, or may be learned by practice of the general inventive concept The foregoing and/or other features and utilities of the present general inventive concept may be achieved by providing an image forming apparatus including a photosensitive unit to form an electrostatic latent image, a printing medium storage unit to store a printing medium, a pickup device to pick up the printing medium from the printing medium storage unit, at least one developing unit to develop the electrostatic latent image of the photosensitive unit into a visual image, an optical sensor to inspect the visual image, and a cleaning unit operatively coupled with the pickup device to clean a light window arranged at the optical sensor.

The photosensitive unit may include a photosensitive body to form the electrostatic latent image, the image forming apparatus may further include an intermediate transfer belt to receive a visual image formed on the photosensitive body to transfer the visual image to the printing medium, and the optical sensor may inspect the visual image on the intermediate transfer belt.

The photosensitive unit may include a photosensitive body to form the electrostatic latent image, the developing unit may include a plurality of developing units to respectively supply a plurality of corresponding developing agents to the photosensitive body to develop the electrostatic latent image into a visual image, and the optical sensor may inspect the visual image on the photosensitive body.

The pickup device may include a pickup roller to pick up the printing medium from the printing medium storage unit while rotating, a pickup shaft to transfer rotary force to the pickup roller, and a cam installed around the pickup shaft to rotate by receiving power from the pickup shaft, and the cleaning unit may clean the light window according to rotation of the cam.

The cleaning unit may include a cleaning blade to clean the light window while moving and an engagement lever provided thereat with the cleaning blade and rotating according to the rotation of the cam.

The engagement lever may include a hinge protrusion such that the engagement lever is rotatably installed, a blade installation portion to install the cleaning blade, and an engagement portion being in contact with the cam to enable the engagement lever to be rotated by the cam.

The cleaning unit may include a return spring to return the engagement lever to an original position.

The image forming apparatus may further include an installation bracket to install the optical sensor, wherein the engagement lever is rotatably installed at the installation bracket through the hinge protrusion.

The foregoing and other features and utilities of the present general inventive concept may also be achieved by providing an image forming apparatus including a photosensitive unit to form an electrostatic latent image, a developing unit to develop the electrostatic latent image of the photosensitive unit into a visual image, a printing medium storage unit to store a printing medium, a pickup device to supply the printing medium of the printing medium storage unit to the developing unit, an optical sensor to inspect the visual image, a cleaning unit to clean a light window arranged at the optical sensor, and a cam rotatably coupled with the pickup device to operate the cleaning unit.

The foregoing and other features and utilities of the present general inventive concept may also be achieved by providing an image forming apparatus including an image forming unit to form a visual image, a pickup device to feed a printing medium such that the printing medium receives the visual image from the image forming unit, an optical sensor to inspect the visual image of the image forming unit, and a cleaning unit to move according to a movement of the pickup device to clean the optical sensor.

The image forming unit may include a photosensitive unit to form an electrostatic latent image, and at least one developing unit to develop the electrostatic latent image of the photosensitive unit into the visual image, and the optical sensor may be disposed to inspect the visual image of the photosensitive unit.

The image forming unit may include a photosensitive unit to form an electrostatic latent image, at least one developing unit to develop the electrostatic latent image of the photosensitive unit into the visual image, and a transfer belt to receive the visual image from the photosensitive unit, and the optical sensor may be disposed to inspect the visual image of the transfer belt.

The cleaning unit may include an elastic element, and the cleaning unit may move according to a bias force form the elastic element and a power from the cam between an original position and a cleaning position to clean the optical sensor.

The cleaning unit may include an elastic element; and the elastic element applies a bias force to the cleaning unit to move the cleaning unit when the cam does not apply a force to move the cleaning unit.

The cleaning unit may be disposed between the pickup device and the image forming unit.

The foregoing and other features and utilities of the present general inventive concept may also be achieved by providing a method of operating an image forming apparatus having an image forming unit to form a visual image and a pickup device to feed a printing medium such that the printing medium receives the visual image from the image forming unit, the method including disposing an optical sensor to inspect the visual image of the image forming unit, and moving a cleaning unit according to a movement of the pickup device to clean the optical sensor.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
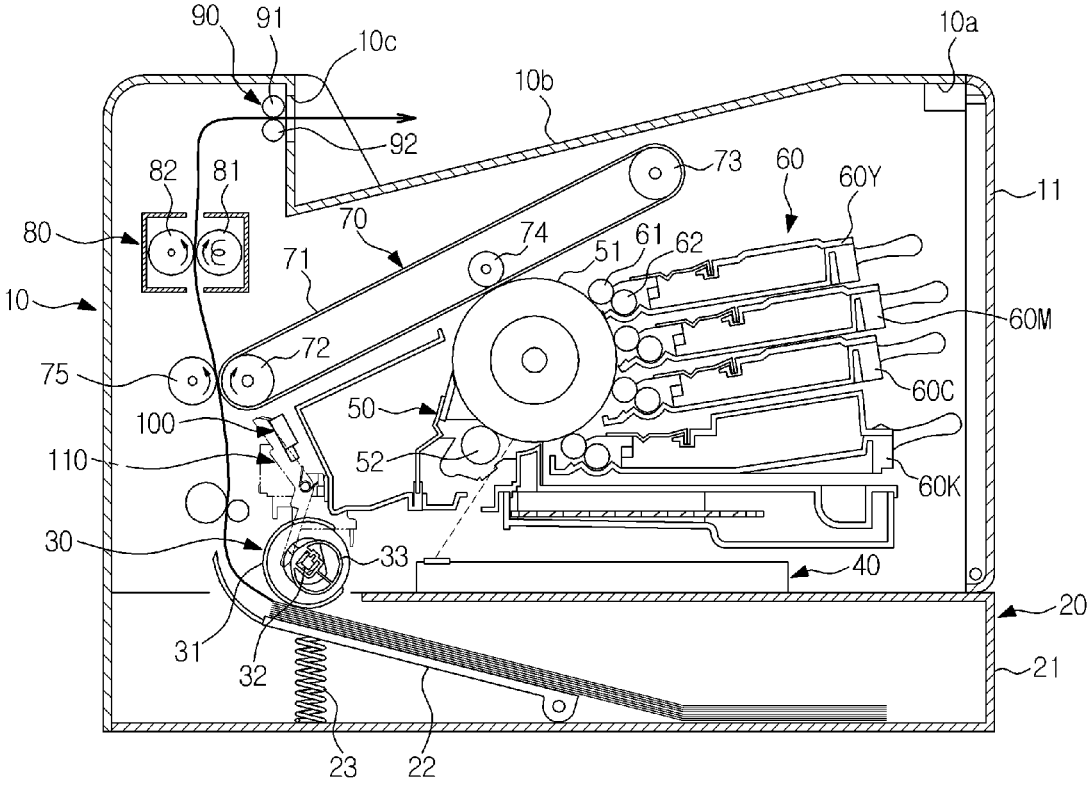
FIG. 1 is a sectional view illustrating an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Hereinafter, an image forming apparatus according to an embodiment will be described in detail with reference to the accompanying drawings.

As illustrated in FIG. 1, the image forming apparatus includes a main body 10, a printing medium storage unit 20, a pickup device 30, an optical scanning unit 40, a photosensitive unit 50, a developing unit 60, a transfer unit 70, a fusing unit 80, and a printing medium discharge unit 90.

The main body 10 forms the external appearance of the image forming apparatus and supports various components disposed in the main body 10. The main body 10 includes a portion provided at one side thereof to define an opening 10*a* through which inner components of the main body 10 are attachable to and detachable from the main body 10, and a side cover 11 is installed at the portion of the opening 10*a* such that a lower end of the side cover 11 is rotatably installed at the main body 10 and thus the side cover 11 opens or closes the opening 10*a* while rotating. The body 10 is provided at a top thereof with a loading portion 10*b* on which a printing medium having a final image formed thereon is loaded. The loading portion 10*b* is provided at one side thereof with a paper discharge portion 10*c* through which the printing medium having a final image formed thereon is discharged.

The printing medium storage unit 20 includes a cassette 21 to store printing media S, a knock-up plate 22 disposed in the cassette 21 and loading the printing media S thereon, and an elastic member 23 to elastically support the knock-up plate 22.

The pickup device 30 supplies the printing media S of the printing medium storage unit 20 to the developing unit 60. The pickup device 30 includes a pickup roller 31 to pick up the printing media S stored in the printing medium storage unit 20 one by one and a pickup shaft 32 to transfer a rotary force of rotation source unit (not illustrated) to the pickup roller 31 so that the pickup roller 31 rotates.

The optical scanning unit 40 is disposed below the photosensitive unit 50 to scan light corresponding to image information to a photosensitive body 51, which will be described below, so that an electrostatic latent image is formed on a surface of the photosensitive body 51.

The photosensitive unit 50 includes the photosensitive body 51 on which the electrostatic latent image formed by the optical scanning unit 40 is formed and a visual image is formed by a developing agent supplied by the developing unit 60 and a charging roller 52 to charge the photosensitive body 51 with predetermined potential before light is scanned by the optical scanning unit 40.

The developing unit 60 supplies a developing agent to the photosensitive body 51 on which the electrostatic latent image is formed to develop the electrostatic latent image of the photosensitive body 51 into a visual image. The developing unit 60 includes four developers, namely, developers 60Y, 60M, 60C and 60K which accommodate developing agents of different colors, i.e., yellow (Y), magenta (M), cyan (C), and black (K), respectively.

Each of the developers 60Y, 60M, 60C and 60K is disposed to face the photosensitive body 51 and includes a developing roller 61 to supply the corresponding developing agent to the photosensitive body 51 and a supply roller 62 to supply the corresponding developing agent to the developing roller 61.

The transfer unit 70 includes an intermediate transfer belt 71 that is supported and rotated by a pair of support rollers 72 and 73 and receives the visual image formed on the photosensitive body 51 to transfer the visual image to the printing medium, a first transfer roller 74 disposed to face the photosensitive body 51 through the intermediate transfer belt 71 intervening therebetween to transfer the visual image formed on the photosensitive body 51 to the intermediate transfer belt 71, and a second transfer roller 75 disposed to face the support roller 72 through the intermediate transfer belt 71 intervening therebetween to transfer an image formed on the intermediate transfer belt 71 to the printing medium.

The fusing unit 80 includes a heating roller 81 having a heat source and a pressing roller 82 facing the heating roller 81 to press the printing medium against the heating roller 81. Thus, the visual image transferred to the printing medium passes between the heating roller 81 and the pressing roller 82, and while passing therebetween, the visual image is fused to the printing medium by heat transferred by the heating roller 81 and pressure applied between the heating roller 81 and the pressing roller 82.

The printing medium discharge unit 90 includes a paper discharge roller 91 and a paper discharge backup roller 92 that are installed at an inner side of the paper discharge portion 10*c* to discharge the printing medium having passed through the fusing unit 80 to the outside of the main body 10.

Hereinafter, an operation of the image forming device will be briefly described. When printing starts, a surface of the photosensitive body 51 is uniformly charged by the charging roller 52. Then, light corresponding to image information of any one color, e.g., yellow is irradiated to the uniformly charged surface of the photosensitive body 51 by the optical scanning unit 40, and an electrostatic latent image corresponding to the yellow image is formed on the photosensitive body 51.

Subsequently, a developing bias of a bias generating unit (not illustrated) is applied to the developing roller 61 of the developer 60Y and thus a yellow developing agent is attached to the electrostatic latent image and consequently, a yellow visual image is formed on the photosensitive body 51. The visual image is transferred to the intermediate transfer belt 71 by the first transfer roller 72.

After image transfer corresponding to one page for the yellow color is completed, the above-described processes are repeated for magenta, cyan and black colors and thus a color image, formed by overlapping the yellow, magenta, cyan, and black images, is completed on the intermediate transfer belt 71. The completed color image is transferred to the printing medium passing between the intermediate transfer belt 71 and the second transfer roller 75, and the printing medium passes through the fusing unit 80 and the printing medium discharge unit 90 to be discharged to the outside.

The photosensitive unit 50, the developing unit 60, the transfer unit 70, and/or the fusing unit 80 may be referred to as an image forming unit to form a visible image and transfer the formed visible image to the printing medium.

Figure 2:
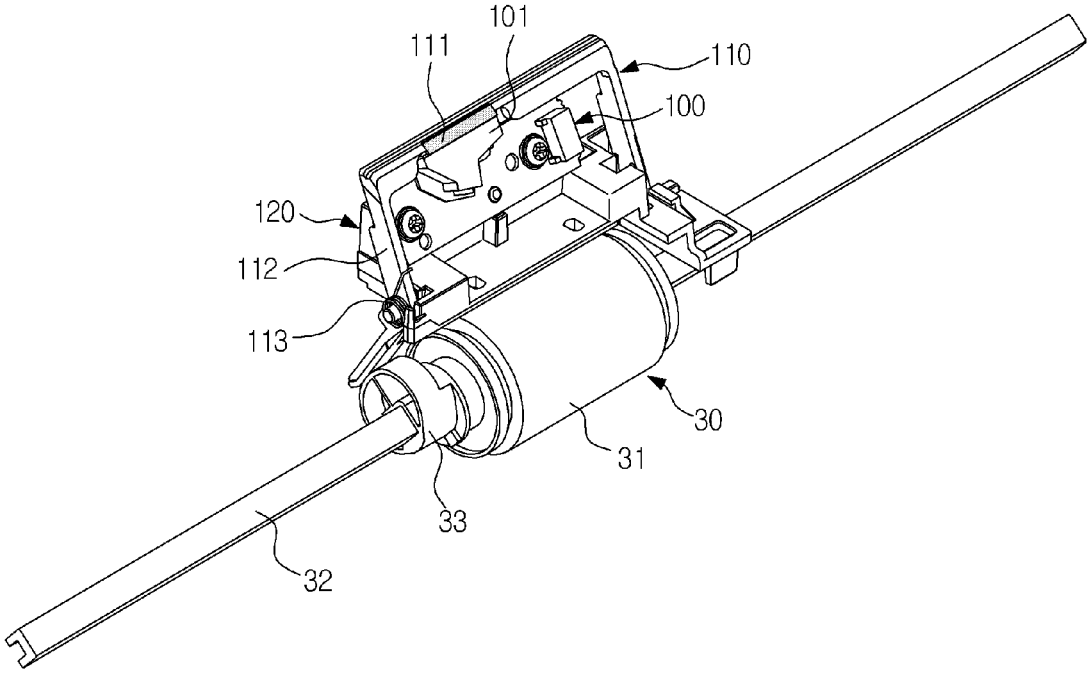
FIG. 2 is a perspective view illustrating a pickup device, an optical sensor unit, and a cleaning unit usable in an image forming apparatus according to an embodiment of the present general inventive concept.
Figure 3:
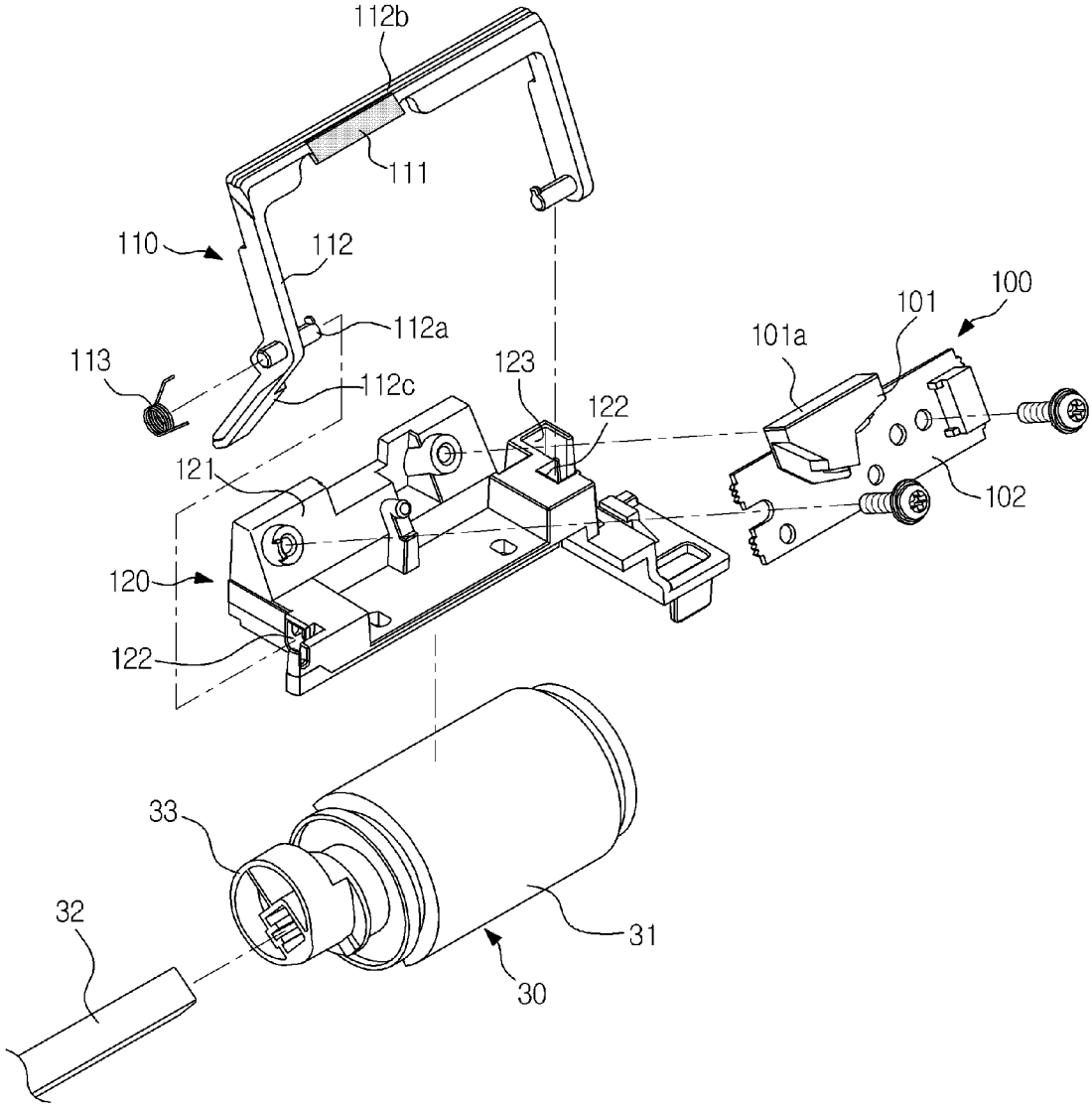
FIG. 3 is an exploded perspective view illustrating the pickup device, the optical sensor unit, and the cleaning unit of FIG. 2.

As illustrated in FIGS. 2 and 3, the image forming apparatus further includes an optical sensor unit 100 to inspect the visual image transferred to the intermediate transfer belt 71, a cleaning unit 110 to clean the optical sensor unit 100, and an installation bracket 120 to install the optical sensor unit 100 and the cleaning unit 110. The optical sensor unit 100 may be disposed to detect the formed visual image of the image forming unit. The optical sensor unit 100 may generate a signal corresponding to the inspected (detected) visual image and output the generated signal to a controller (not illustrated) such that the controller controls functions and operations of components of the image forming apparatus.

The optical sensor unit 100 includes an optical sensor 101 having a light emitting portion and a light receiving portion therein and a circuit substrate 102 for control of the optical sensor 101. The optical sensor 101 arranged to face the intermediate transfer belt 71 is provided, at a front surface thereof, with a light window 101*a* formed of a light transmissible material so that light transmits the light window 101*a*, to inspect the visual image on the intermediate transfer belt 71.

The cleaning unit 110 includes a cleaning blade 111 to clean the light window 101*a* while moving, in contact with the light window 101*a* of the optical sensor 101. In the present embodiment, the cleaning unit 110 is operated by the pickup device 30. That is, the cleaning unit 110 operates by receiving power from the pickup device 30.

To enable the cleaning unit 110 to operate by receiving power from the pickup device 30, the pickup device 30 includes a cam 33 installed around the pickup shaft 32 to be rotatably by the pickup device 30, and the cleaning unit 110 includes an engagement lever 112 rotated by the cam 33 to move the cleaning blade 111 to a cleaning position and a return spring 113 to return the rotated engagement lever 112 to an original position. The cleaning blade 11 moves between two different positions with respect to the installation bracket 120 or the optical sensor unit 100 according to a bias force from the return spring 113 and/or a power from the cam 33. The cleaning blade 11 may clean the optical sensor unit 100 when moving between the original position and the cleaning position.

The engagement lever 112 includes a pair of hinge protrusions 112*a* such that the engagement lever 112 is rotatably installed inside the main body 10, a blade installation portion 112*b* that extends upward from the hinge protrusions 112*a* in a reverse U-shaped form and is provided at the center thereof with the cleaning blade 111, and an engagement portion 112*c* that extends downward from at least one of the two hinge protrusions 112*a* and is in contact with the cam 33 so that the engagement lever 112 rotates by receiving power through the cam 33. The return spring 113 may be a torsion spring and is installed at the hinge protrusion 112*a*. The return spring 113 has one end coupled to the engagement lever 112 and the other end coupled to the installation bracket 120 to apply a force to the cleaning unit 110 with respect to the installation bracket 120.

The installation bracket 120 includes a fixing portion 121 to fix the optical sensor unit 100, hinge portions 122 arranged at opposite sides of the installation bracket 120 such that the two hinge protrusions 112*a* of the engagement lever 112 are rotatably installed respectively at the hinge portions 122, and a control portion 123 engaged with the engagement lever 112 to control a rotation angle of the engagement lever 112 to a certain level or less.

Hereinafter, an operation of the cleaning unit 110 having the above-described structure operatively coupled with the pickup device 30 will be described with reference to FIGS. 4 and 5.

As the pickup shaft 32 rotates by receiving power, the pickup roller 31 and the cam 33 installed around the pickup shaft 32 rotate by receiving power through the pickup shaft 32. As illustrated in FIG. 5, the pickup roller 31 picks up a printing medium stored in the printing medium storage unit 20 sheet by sheet while rotating, and the cam 33 presses the engagement portion 112*c* of the engagement lever 112 while rotating such that the engagement lever 112 rotates. As the engagement lever 112 rotates, a front end of the cleaning blade 111 installed at the blade installation portion 112*b* of the engagement lever 112 moves along a top surface of the light window 101*a* while in contact with the top surface thereof to clean toner or foreign material accumulated on the light window 101*a*.

Figure 4:
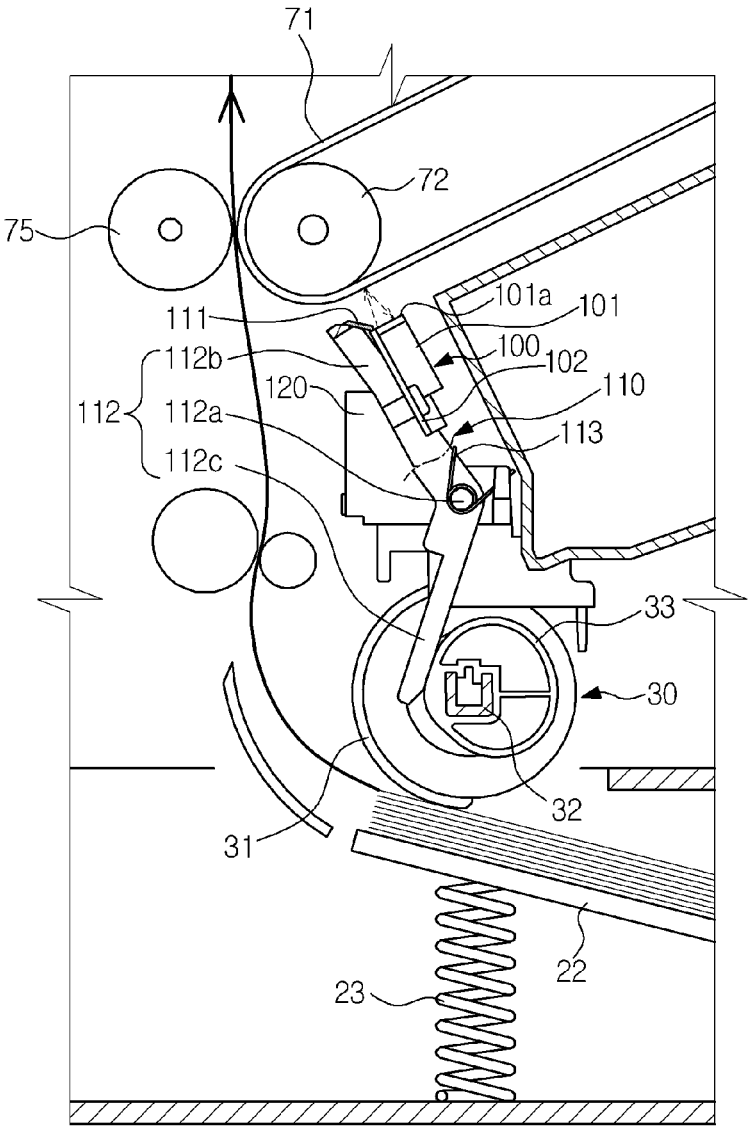
FIGS. 4 and 5 are side views illustrating operations of the pickup device, the optical sensor unit, and the cleaning unit of FIG. 3.
Figure 5:
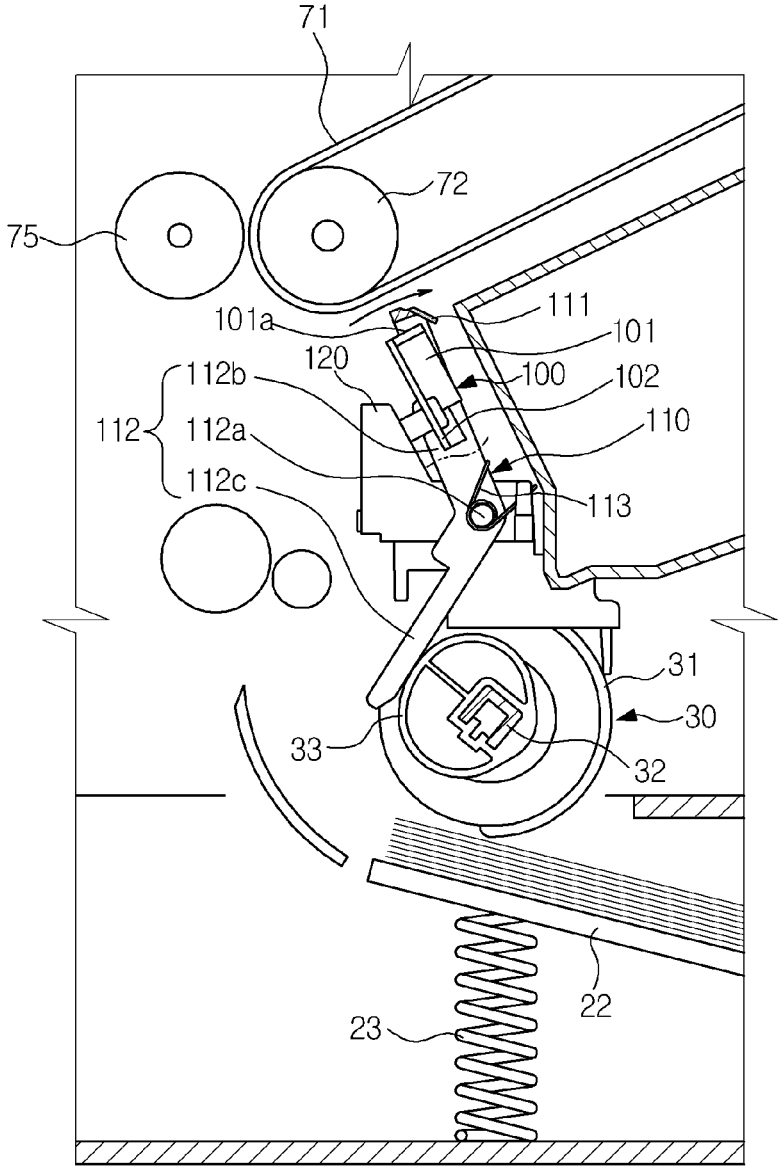

Subsequently, when the cam 33 is rotated by the pickup shaft 32, the engagement lever 112 returns to the original position by elastic resilience of the return spring 113 as illustrated in FIG. 4. Accordingly, the cleaning blade 111 also returns to the original position as illustrated in FIG. 4.

As described above, the cleaning unit 110 operates by receiving power from the cam 33 of the pickup device 30, and thus, an additional driving source for operating the cleaning unit 110 is not needed. In addition, the cleaning unit 110 is not in contact with the printing medium, and the like, and thus damage to the image formed on the printing medium may be prevented.

In the present embodiment, the optical sensor unit 100 is used to inspect a visual image formed on the intermediate transfer belt 71. However, the present general inventive concept is not limited thereto. It is possible that the optical sensor unit 100 may be used to inspect the visual image formed on the photosensitive body 51. In this case, the optical sensor unit 110 may be disposed at a position to inspect the visual image formed on the photosensitive body 51. It is also possible that the optical sensor unit 110 may include a first optical sensor unit disposed to inspect a first image of the intermediate transfer belt 71 and a second optical sensor unit disposed to inspect a second image of the photosensitive body 51. In this case, the cleaning unit 110 may include a first cleaning unit to clean the first optical sensor unit and a second cleaning unit to clean the second optical sensor unit. The cam 33 may be disposed to operate both the first and second cleaning units. It is possible that the cam 33 may include first and second cams coupled to the pickup shaft 32 and disposed to correspond to the respective first and second cleaning units.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. An image forming apparatus comprising:

a photosensitive unit having a photosensitive body on which an electrostatic latent image is formed by an optical scanning unit;

a printing medium storage unit to store a printing medium;

a pickup device to pick up the printing medium from the printing medium storage unit;

at least one developing unit to develop the electrostatic latent image of the photosensitive unit into a visual image;

an optical sensor disposed below the photosensitive unit to inspect the visual image; and a cleaning unit engaged with the pickup device to clean a light window arranged at the optical sensor.

2. The image forming apparatus according to claim 1, wherein:

the image forming apparatus further comprises an intermediate transfer belt to receive a visual image formed on the photosensitive body to transfer the visual image to the printing medium; and the optical sensor inspects the visual image on the intermediate transfer belt.

3. The image forming apparatus according to claim 1, wherein:

the developing unit comprises a plurality of developing units to respectively supply a plurality of corresponding developing agents to the photosensitive body to develop the electrostatic latent image into a visual image; and the optical sensor inspects the visual image on the photosensitive body.

4. The image forming apparatus according to claim 1, wherein:

the pickup device comprises a pickup roller to pick up the printing medium from the printing medium storage unit while rotating, a pickup shaft to transfer rotary force to the pickup roller, and a cam installed around the pickup shaft to rotate by receiving power from the pickup shaft; and the cleaning unit cleans the light window according to rotation of the cam.

5. The image forming apparatus according to claim 4, wherein the cleaning unit comprises:

a cleaning blade to clean the light window while moving; and an engagement lever provided thereat with the cleaning blade and rotating according to the rotation of the cam.

6. The image forming apparatus according to claim 5, wherein the engagement lever comprises:

a hinge protrusion such that the engagement lever is rotatably installed;

a blade installation portion to install the cleaning blade; and an engagement portion being in contact with the cam to enable the engagement lever to be rotated by the cam.

7. The image forming apparatus according to claim 5, wherein the cleaning unit comprises a return spring to return the engagement lever to an original position.

8. The image forming apparatus according to claim 6, further comprising:

an installation bracket to install the optical sensor, wherein the engagement lever is rotatably installed at the installation bracket through the hinge protrusion.

9. An image forming apparatus comprising:

a photosensitive unit having a photosensitive body on which an electrostatic latent image is formed by an optical scanning unit;

a developing unit to develop the electrostatic latent image of the photosensitive unit into a visual image;

a printing medium storage unit to store a printing medium;

a pickup device to supply the printing medium of the printing medium storage unit to the developing unit;

an optical sensor to inspect the visual image;

a cleaning unit to clean a light window arranged at the optical sensor; and a cam rotatably coupled with the pickup device to operate the cleaning unit.

10. The image forming apparatus according to claim 9, wherein:

the pickup device comprises a pickup roller to pick up the printing medium from the printing medium storage unit while rotating and a pickup shaft to transfer rotary force to the pickup roller; and the cam is installed around the pickup shaft to receive power from the pickup shaft.

11. The image forming apparatus according to claim 9, wherein the cleaning unit comprises a cleaning blade to clean the light window while moving and an engagement lever provided thereat with the cleaning blade and rotating according to the rotation of the cam.

12. The image forming apparatus according to claim 11, wherein the engagement lever comprises:

a hinge protrusion such that the engagement lever is rotatably installed;

a blade installation portion to install the cleaning blade; and an engagement portion being in contact with the cam to enable the engagement lever to be rotated by the cam.

13. The image forming apparatus according to claim 12, further comprising:

an installation bracket to install the optical sensor, wherein the engagement lever is rotatably installed at the installation bracket through the hinge protrusion.

14. An image forming apparatus comprising:

an image forming unit to form a visual image;

a pickup device to feed a printing medium such that the printing medium receives the visual image from the image forming unit;

an optical sensor to inspect the visual image of the image forming unit; and a cleaning unit to move according to a movement of the pickup device to clean the optical sensor.

15. The image forming apparatus of claim 14, wherein:

the image forming unit includes a photosensitive unit to form an electrostatic latent image, and at least one developing unit to develop the electrostatic latent image of the photosensitive unit into the visual image; and the optical sensor is disposed to inspect the visual image of the photosensitive unit.

16. The image forming apparatus of claim 14, wherein:

the image forming unit includes a photosensitive unit to form an electrostatic latent image, at least one developing unit to develop the electrostatic latent image of the photosensitive unit into the visual image, and a transfer belt to receive the visual image from the photosensitive unit; and the optical sensor is disposed to inspect the visual image of the transfer belt.

17. The image forming apparatus of claim 14, wherein:

the cleaning unit includes an elastic element; and the cleaning unit moves according to a bias force form the elastic element and a power from the cam between an original position and a cleaning position to clean the optical sensor.

18. The image forming apparatus of claim 14, wherein:

the cleaning unit includes an elastic element; and the elastic element applies a bias force to the cleaning unit to move the cleaning unit when the cam does not apply a force to move the cleaning unit.

19. The image forming apparatus of claim 14, wherein the cleaning unit is disposed between the pickup device and the image forming unit.

20. A method of operating an image forming apparatus having an image forming unit to form a visual image and a pickup device to feed a printing medium such that the printing medium receives the visual image from the image forming unit, the method comprising:

disposing an optical sensor to inspect the visual image of the image forming unit; and moving a cleaning unit according to a movement of the pickup device to clean the optical sensor.

* * * * *